United States Patent [19]

Zielke et al.

[11] Patent Number: 4,926,616

[45] Date of Patent: May 22, 1990

[54] CASSETTE PACKAGING SYSTEM

[75] Inventors: Darrell W. Zielke, Valencia; Kenneth D. Dean, Sepulveda, both of Calif.

[73] Assignee: Paktec Automation, Valencia, Calif.

[21] Appl. No.: 305,243

[22] Filed: Feb. 1, 1989

[51] Int. Cl.[5] ..... B65B 9/10; B65B 43/32; B65B 5/04

[52] U.S. Cl. ..... 53/585; 53/169; 53/566; 53/567

[58] Field of Search ..... 53/564, 566, 258, 169, 53/585, 567

[56] References Cited

U.S. PATENT DOCUMENTS

| | | | |
|---|---|---|---|
| 1,981,463 | 11/1934 | Nejedly | 53/169 X |
| 3,030,869 | 4/1962 | Galloway | 53/564 X |
| 3,412,652 | 11/1968 | McIntyre | 53/564 X |
| 3,443,357 | 5/1969 | Bacon et al. | 53/566 |
| 3,541,760 | 11/1970 | Hickin | 53/169 X |
| 3,802,152 | 4/1974 | Strub | 53/585 X |
| 3,807,121 | 4/1974 | Mundt et al. | 53/564 X |
| 4,201,027 | 5/1980 | Ilsemann | 53/564 X |
| 4,244,282 | 1/1981 | Ruzand et al. | 53/566 X |
| 4,744,206 | 5/1988 | Winter | 53/585 |
| 4,854,111 | 8/1989 | Roberts et al. | 53/566 X |

*Primary Examiner*—Horace M. Culver

*Attorney, Agent, or Firm*—Lyon & Lyon

[57] ABSTRACT

A mechanism packaging tape cassettes in cardboard sleeves including a controlled cassette guideway which advances cassettes to a packaging station and a controlled loading track which advances sleeves to the packaging station for positioning on the cassettes. The guideway may either receive cassettes from an incoming belt or a hopper. A pusher mechanism advances the cassettes to the packaging station while a retractable stop insures proper location of the cassette. The cassette is slightly raised above the surface of the guideway to be properly positioned for receiving the enclosing sleeve. The loading track includes a hopper to receive collapsed sleeves. The sleeves are released one-at-a-time into the loading track where a sleeve pusher advances the sleeves one-at-a-time into a die defined by opposed channels. The channels are spaced such that the continued pushing of the sleeve therethrough causes it to assume its appropriate rectangular configuration. Upon achieving this configuration, the sleeve is further pushed onto the cassette to complete the packaging operation. The cassette is then bumped on as a subsequent cassette takes its place at the packaging station to receive the next expanded sleeve.

19 Claims, 6 Drawing Sheets

FIG. 11.
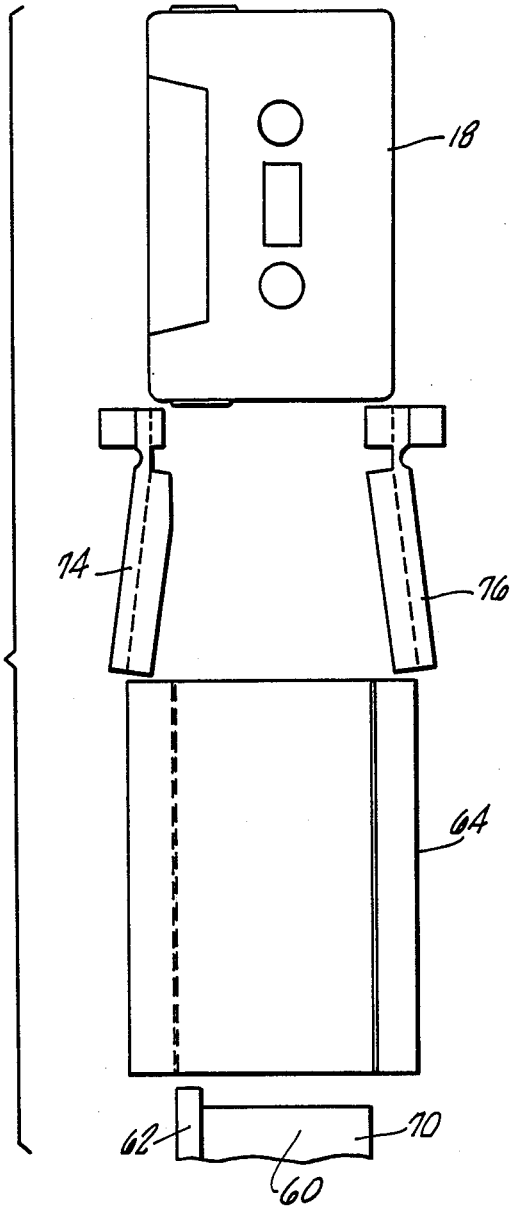
FIG. 13.
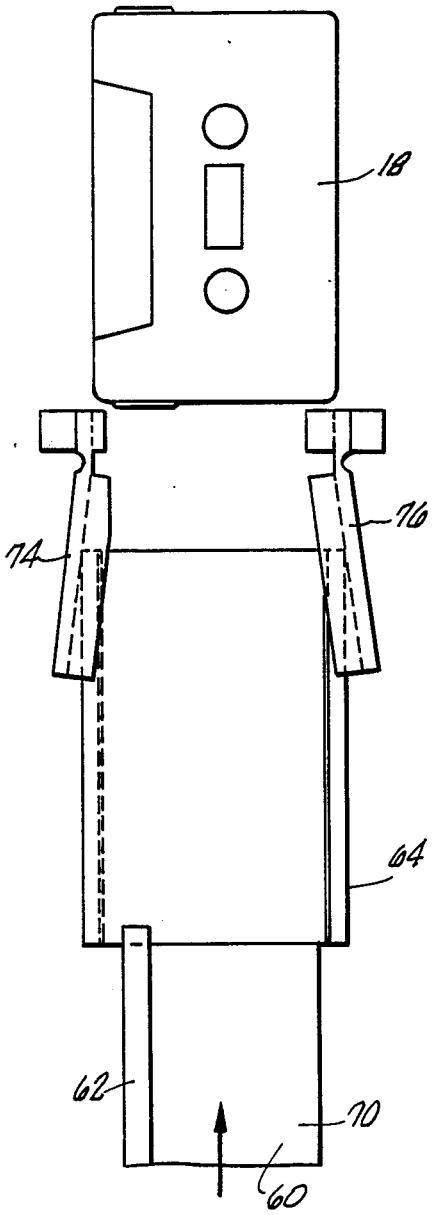
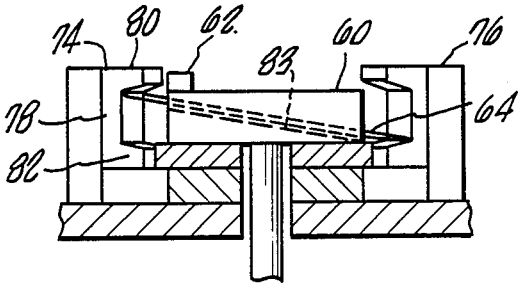
FIG. 12.
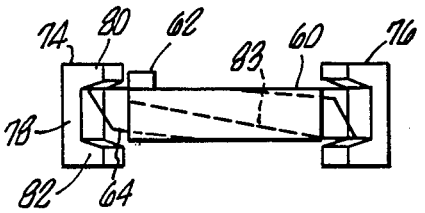
FIG. 14.

FIG. 15.
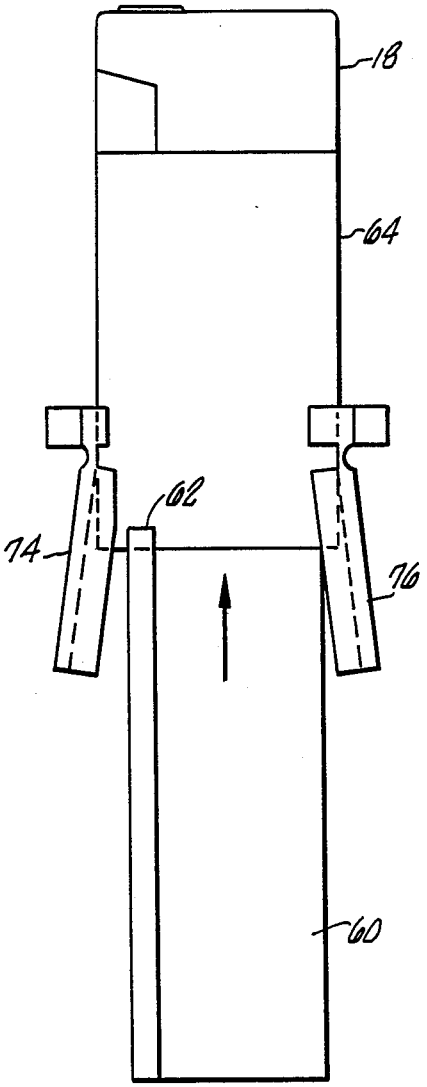
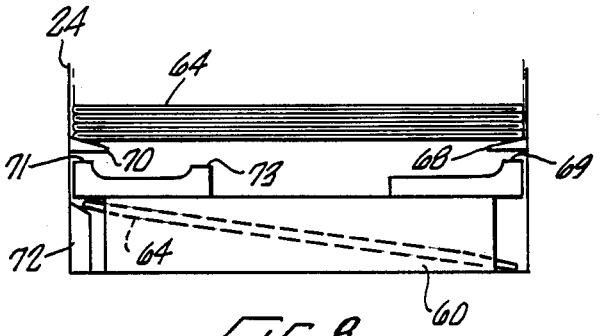
FIG. 8.
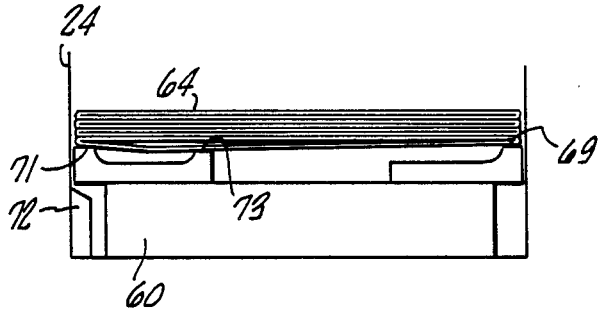
FIG. 9.
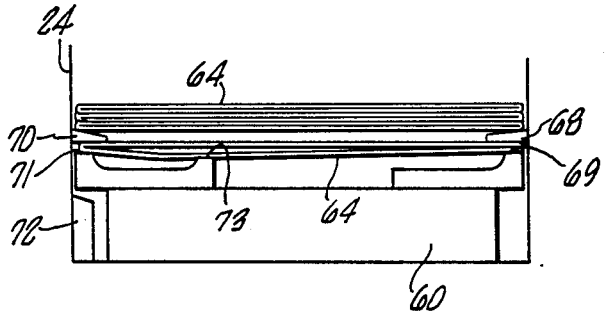
FIG. 10.
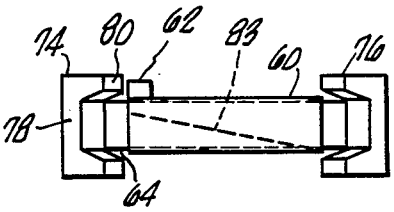
FIG. 16.

CASSETTE PACKAGING SYSTEM

BACKGROUND OF THE INVENTION

The field of the present invention is packaging mechanisms for tape cassettes.

Magnetic tape for both audio and visual devices has come to be packaged in standardized tape cassettes. Common today are audio cassettes and ¾ inch and 1 inch video cassettes. With audio cassettes, and to a lesser extent video cassettes, expensive packaging has been employed to enclose and protect such devices. In the case of audio cassettes, the rigid plastic boxes now account for as much as 20% of the cost of the packaged product. A need has developed for less expensive packaging for such devices.

In an effort to reduce the cost of packaging of such devices, sleeves of cardboard or other inexpensive material have been developed for packaging the tape cassettes. These sleeves closely fit the standardized cassettes and extend along the longest dimension of the cassette with openings at either end. The sleeves have two opposed wide sides and two opposed narrow sides so as to conform to the general shape of such cassettes. Conveniently they come with each of two adjacent sides, one wide side and one narrow side, extending in substantially the same planes. Thus, the sleeves come completely collapsed along two of four folds with the other folds being prescored to inherently achieve a rectangular cross section when the folded edges are squeezed toward one another.

With such sleeves, actual cost savings are fully realized only if the sleeves can be automatically expanded to the rectangular cross section and positioned over the cassette. The nonrectangular configuration of the sleeves when supplied and the close fit of the sleeves over the cassette complicate automation of this packaging.

SUMMARY OF THE INVENTION

The present invention is directed to a mechanism for loading tape cassettes into packaging sleeves. The mechanism presents an automated process by which packaging sleeves and tape cassettes are separately presented to the mechanism which then expands the sleeves and places them over tape cassettes on a fully automated basis.

In a first aspect of the present invention, converging opposed channels receive packing sleeves in a flattened configuration. The sleeves are expanded as they are forced through the channels by a pusher to present the sleeves in an appropriate orientation and configuration for facile placement over a waiting cassette.

In another aspect of the present invention, a guideway is provided which accurately positions the cassette for receipt of the expanded packing sleeve. Operation of the mechanism is timed to receive a cassette at a packaging station just prior to the introduction of a properly oriented and configured sleeve to slide over the cassette. The packaged cassette then moves off station and is replaced by a properly oriented cassette for the next incoming sleeve.

In a further object of the present invention the collapsed sleeves are fed one at a time into the system by actuated knife blades capable of separating individual sleeves from a stack of such collapsed sleeves.

Accordingly, it is an object of the present invention to provide an automated mechanism for packing tape cassettes in sleeves. Other and further objects and advantages will appear hereinafter.

BRIEF DESCRIPTION OF THE DRAWINGS

FIG. 8 is an end view of the sleeves as positioned in FIG. 5.

FIG. 9 is an end view of the sleeves as positioned in FIG. 6.

FIG. 10 is an end view of the sleeves as positioned in FIG. 7.

FIG. 11 is a plan view of a sleeve on the loading track with a cassette positioned for receipt thereof.

FIG. 13 is a plan view of a sleeve on the loading track with a cassette positioned for receipt thereof.

FIG. 14 is a cross-sectional end view of the arrangement of FIG. 13.

FIG. 15 is a plan view of a sleeve on the loading track with a cassette positioned for receipt thereof.

FIG. 16 is a cross-sectional end view of the arrangement of FIG. 15.

FIG. 17 is a schematic of the pneumatic system of the present invention.

DETAILED DESCRIPTION OF THE PREFERRED EMBODIMENT

Figure 1:
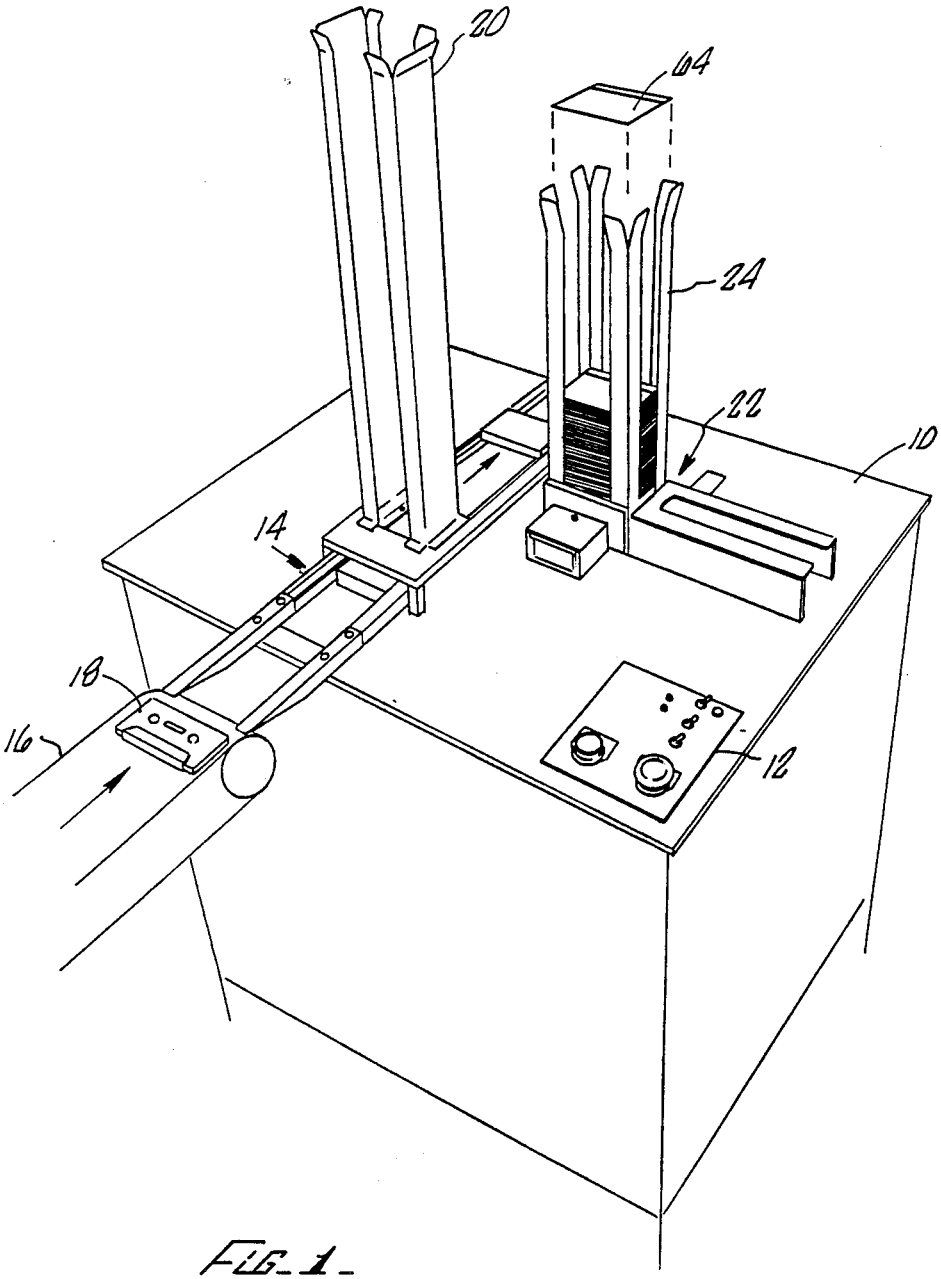
FIG. 1 is a perspective view of the system of the present invention.

Turning in detail to the drawings, the overview presented by FIG. 1 illustrates a mechanism for packaging tape cassettes in sleeves. A frame 10 is provided to which the components of the mechanism are fixed. A control panel 12 is arranged on the frame 10. The pneumatics and electronics to run the system are generally located below the upper surface of the frame 10. A cassette guideway 14 is provided for the passage of cassettes through the system. In the present embodiment, two methods of introducing cassettes are presented. A belt 16 may be employed to introduce cassettes to the system from a prior mechanism. One such cassette 18 is illustrated on the conveyor belt. Another form of cassette feed is provided by a cassette hopper 20 located above the cassette guideway 14. Also generally represented is a sleeve loading track, generally designated 22. The sleeve loading track includes a sleeve hopper 24 for introducing the packaging sleeves.

Figure 2:
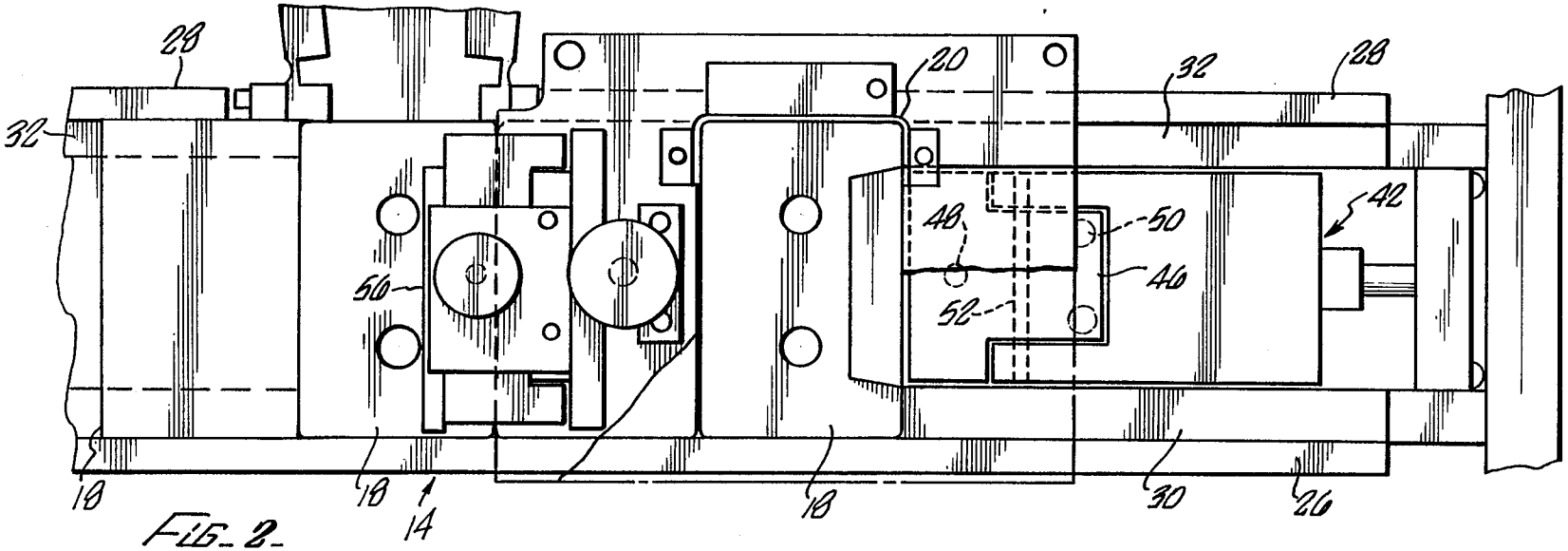
FIG. 2 is a plan view of the cassette guideway of the present invention.
Figure 3:
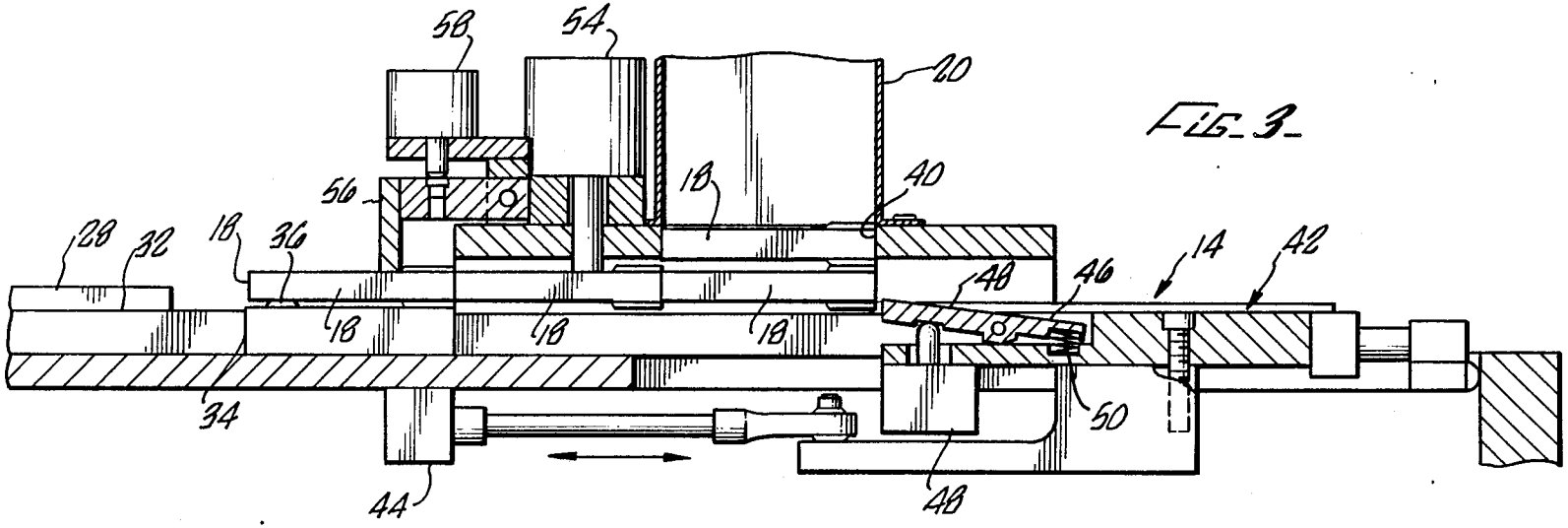
FIG. 3 is a cross-sectional view of the cassette guideway of the present invention.
Figure 4:
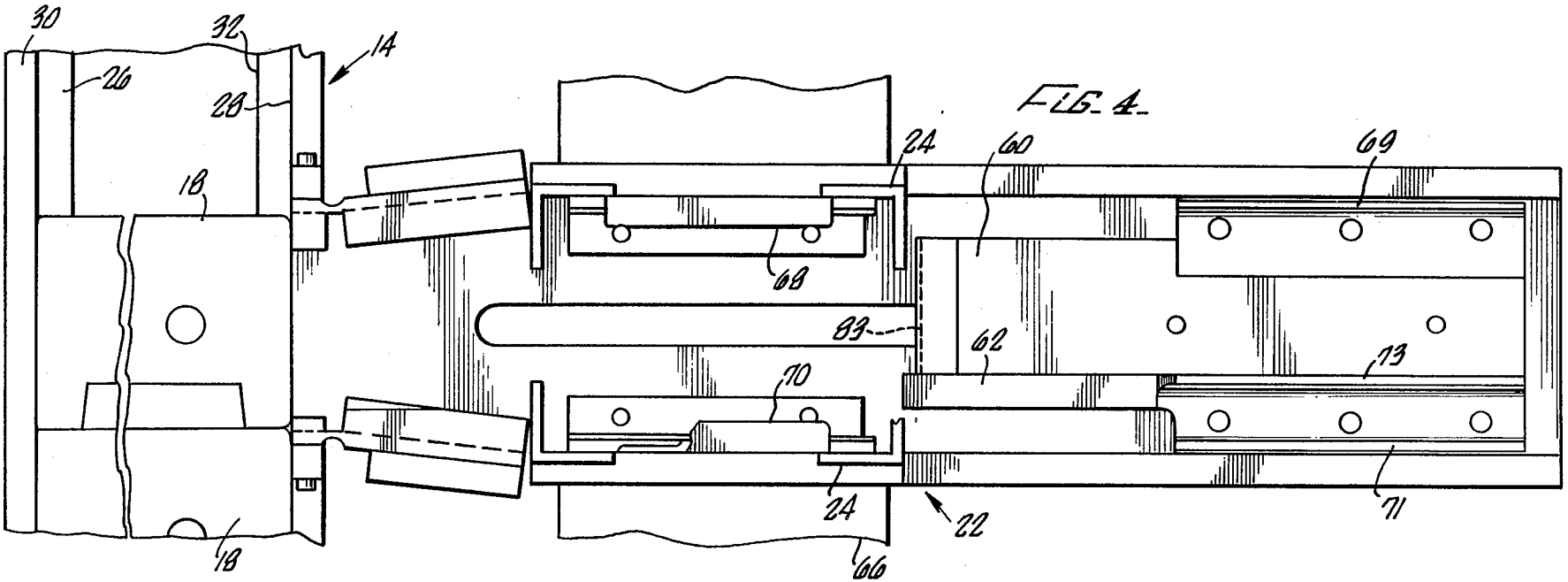
FIG. 4 is a plan view of the sleeve loading track of the present invention.

Turning to FIG. 2, a plan view of the cassette guideway 14 is presented in detail. FIG. 3 illustrates a portion of the guideway in cross-sectional elevation. The cassette guideway 14 includes parallel guide rails 26 and 28. These parallel guide rails 26 and 28 are sized such that a cassette 18 will fit therebetween. The rails are more specifically spaced such that the cassette will fit along its longest dimension therebetween and slide without interference. However, the rails 26 and 28 prevent the cassette from rotating about a vertical axis. The guideway 14 also includes a supporting surface. This supporting surface is provided by two runners 30 and 32 which may be integral with the parallel guide rails 26 and 28, respectively. Thus, cassettes can travel along the guideway 14 as desired.

Located on the guideway 14 is a packaging station located above a block 34. The block 34 forms part of the supporting surface and is located where the loading track extends to the guideway 14. This surface includes a rounded bump 36 which, as shown in FIG. 3, lifts the cassette 18 upwardly so as to partially separate the cassette 18 from the block 34. Because the bump 36 is rounded, it does not interfere with the movement of either cassettes or sleeves.

Also located on the guideway 14 is a supporting structure 38 for the cassette hopper 20. This supporting structure 38 provides a passageway through which the guideway 14 extends. The hopper 20 is aligned with a port 40 located through the supporting structure 38 such that cassettes stacked within the hopper 20 can freely move downwardly to the guideway 14. The underside of the supporting structure 38 at the port 40 is positioned above the guideway 14 such that only one cassette 18 can be slid along the guideway without interfering with the underside of the supporting structure 38. In this way, cassettes 18 are fed in a one-at-a-time manner from the hopper 20.

To advance the cassettes along the guideway 14, a cassette pusher, generally designated 42, rides between elements 30 and 32 in a reciprocating manner under the influence of a pneumatic cylinder 44. The pusher 42 includes a pawl 46 which is actuated by a controlled pin 48 against springs 50. The pawl is rotatably mounted about a pin 52. As the pusher 42 is advanced under the hopper 20 and toward the packaging station, the pawl 46 is raised by the pin 48. During its retraction, the pawl 46 is also in a retracted position assured by operation of the springs 50. As can be seen in FIG. 3, the leading edge of the pawl 46 interferes with the just-released cassette 18. In this way, movement of the cassette pusher 42, to the left as seen in FIG. 3, drives the three cassettes forwardly along the guideway 14.

Two mechanisms are provided to stop the cassettes in appropriate locations. First, an actuated pin 54 directly extends to contact the cassette adjacent to the hopper 20. This pin 54 retains the cassettes being fed into the system from moving the cassette located at the packaging station. Under operation of the system where cassettes are fed in from a conveyor belt, constant pressure may be exerted against the cassettes to move them forwardly along the guideway 14. This actuated pin 54 prevents that forward movement when such is disadvantageous.

A retractable stop 56 is rotatably mounted to the frame so as to come down and engage a cassette 18 located at the packaging station. The retractable stop 56 can engage the raised portion 56 on the cassettes and is timed to be extended when the cassette pusher 42 terminates its forward motion. To actuate the retractable stop 56, an actuated pin 58 engages the retractable stop 56 and is driven by a control system. The retractable stop 56 is actuated as the cassette comes into position on the packaging station and then once the actuating pin 54 is down to secure further advance of the chain of cassettes, the retractable stop 56 is retracted to leave the cassette 18 located at the packaging station free to receive a packaging sleeve.

Once having received a sleeve, cassettes are again advanced by the cassette pusher 42 to position the succeeding cassette on the packaging station and off-load the packaged cassette. The packaged cassette cannot return because the supporting surface 32 located beyond the block 34 is lowered to a slight extent below the upper surface of the block 34. This also helps to prevent having cassettes buckle upwardly when being pushed from the back.

Looking next to the sleeve loading track, generally designated 22 and best illustrated in FIGS. 4 through 16, a sleeve pusher 60 is mounted to the loading track 22 so as to reciprocate back and forth along the track from a position outwardly of the sleeve hopper 24 to a position at the end of the loading track 22 adjacent the packaging station. The pusher 60 includes a finger 62 which extends forwardly of the pusher. The sleeve hopper 24 is arranged to receive packaging sleeves in a collapsed state. The packaging sleeves 64 are of cardboard or other inexpensive material in sheet form which are formed by folds and scored areas to create a rectangular device which is open at both ends. The rectangular device has two opposed wide sides and two opposed narrow sides. The sleeves 64 are received in a flat configuration with one of the wide sides and one of the adjacent narrow sides lying in a plane. Naturally, the other wide side and narrow side also lie in roughly a parallel plane. By squeezing the side edges of the collapsed sleeve 64, the sleeve assumes the rectangular configuration necessary for sliding it over a cassette 18.

Figure 7:
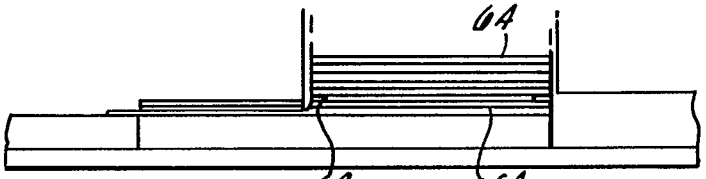
FIG. 7 is a schematic side elevation of the loading track in a third position.
Figure 5:
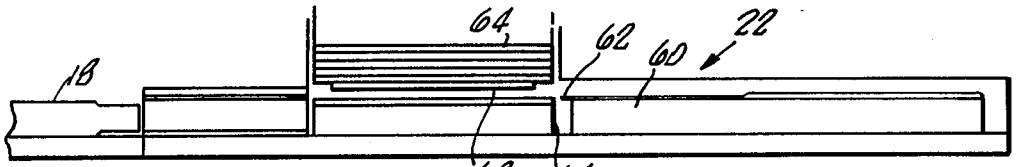
FIG. 5 is a schematic side elevation of the loading track in a first position.
Figure 6:
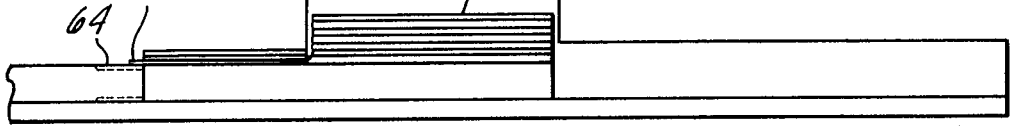
FIG. 6 is a schematic side elevation of the loading track in a second position.

A support structure 66 associated with the hopper 24 also includes knife blades 68 and 70. The knife blades 68 and 70 are articulated by means of pneumatic cylinders to move in and out in unison from the hopper 24. Release of a sleeve 64 is illustrated sequentially in FIGS. 5 through 10. In FIGS. 5 and 8, the knife blades 68 and 70 are retaining a stack of sleeves 64 within the hopper 24. One sleeve 64 has been previously released and is located on the loading track 22. The loading track 22 includes a block 72 which retains the released sleeve 64 in an angled configuration. In this position as illustrated in FIGS. 5 and 8, the sleeve pusher 60 is fully retracted. With the sleeve pusher 60 fully advanced as illustrated in FIGS. 6 and 9, the sleeve which had been dropped onto the loading track 22 has been advanced as will be discussed below. In this position, the knife blades 68 and 70 have been retracted from the hopper 24 such that the sleeve 64 can drop onto the upper surface of the sleeve pusher 60. The knife blades 68 and 70 are then reasserted. It can be seen from FIG. 10 that the knife blades 68 and 70 are raised above the top surface of the sleeve pusher 60 by one thickness of a collapsed packaging sleeve 64. It is advantageous that the knife blades 68 and 70 be finally adjustable so as to insure proper separation of the bottommost sleeve 64 from the remaining stack. The upper surface of the pusher 60 includes upstanding strip surfaces to properly receive the sleeve 64. The outer strip surfaces 69 and 71 support the sleeve 64. The inner strip surface 73 is slightly lower than the surfaces 69 and 71. This provides for the added thickness of the collapsed sleeve 64 which is often encountered at this location. By having the central support lower, the sleeve 64 will rest on the outer strip surfaces and not extend into the path of the extending knife blades 68 and 70. The inner strip surface is useful in assuring that thin sleeves 64 do not bow excessively. If bowed, there is some risk that the sleeve 64 will not properly open later when pushed through the opposed channel elements. Once the blades 68 and 70 are reinserted, the sleeve pusher 60 is fully retracted. A stop prevents the separated sleeve 64 from moving with the pusher to its retracted position. FIGS. 7 and 10 illustrate the position with the bottommost sleeve 64 resting on the sleeve pusher 60 and the remainder of the stack of sleeves 64 separated by the knife blades 68 and 70. With the sleeve pusher 60 fully retracted, the bottommost sleeve 64 falls into the loading track 22 as again illustrated in FIGS. 5 and 8.

Looking to the operation of the sleeve as it is advanced by the sleeve pusher 60, reference is specifically made to FIGS. 11 through 16. As stated above, the sleeves 64 are supplied in a collapsed condition with each two adjacent sides lying in planes. The sleeve is scored so that it will inherently bend at the scored portion to form four corners.

FIG. 11 illustrates the sleeve in the loading track. The sleeve pusher 60 is retracted back of the sleeve 64 and the sleeve is in its collapsed condition. A cassette 18 is properly positioned at the packaging station to receive the sleeve when advanced thereto. It should be noted that the parallel guide rail 28 has a discontinuous portion at the packaging station in order that the sleeve 64 may pass directly onto the cassette 18. The parallel guide rail 26 is continuous across this packaging station and provides the backstop for the cassette 18 when the sleeve is forced thereon.

Located between the sleeve hopper and the packaging station along the loading track 22 are opposed channel elements 74 and 76. The opposed channels 74 and 76 are mirror images of one another and are fixed to the frame. These opposed channel elements 74 and 76 define guidewalls 78 extending upwardly from the loading track 22. Also defined by the opposed channel elements 74 and 76 are inwardly extending flanges 80. The inner surface defining the channel of the flanges 80 is sloped upwardly away from the guidewalls 78. A lower flange 82 is similarly configured on each of the opposed channel elements 74 and 76. Additionally, the opposed channel elements 74 and 76 are mutually converging toward the packaging station. At the outer ends of the opposed channel elements 74 and 76 the guidewalls 78 are spaced as wide as two adjacent sides of the collapsed sleeves. At the end proximate to the packaging station, the opposed channel elements 74 and 76 are spaced one from the other approximately the width of the wide side of the sleeve. Thus, a die is formed for forcing the collapsed sleeve 64 into a rectangular configuration. Where the sleeve 64 enters the opposed channel elements 74 and 76 it is as wide as the combined widths of the wide side and narrow side of a sleeve. As it exits the dies, the sleeve 64 is only as wide as the wide side of the sleeve.

Figure 12:
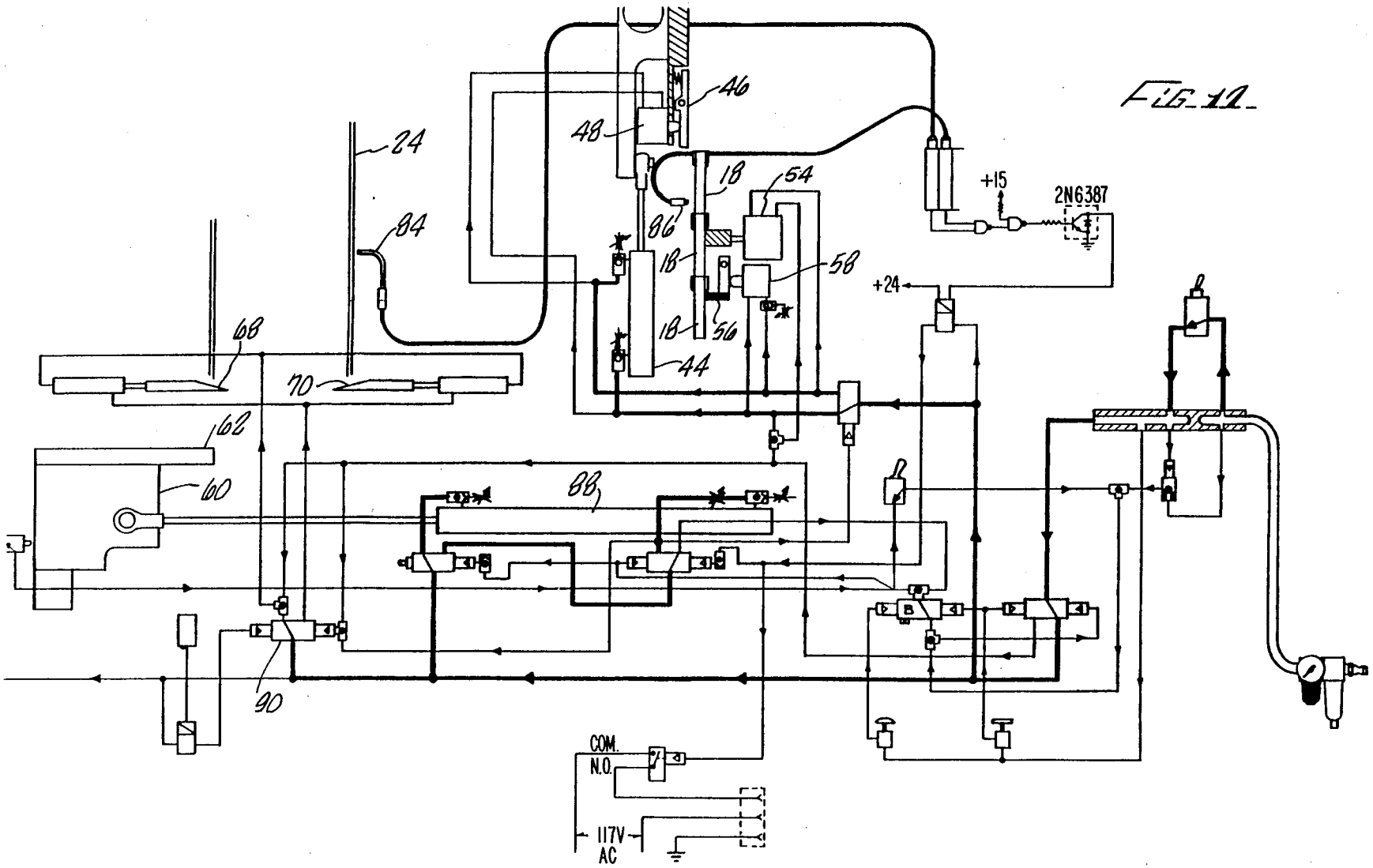
FIG. 12 is a cross-sectional end view of the arrangement of FIG. 11.

In progressing through the die defined by the opposed channel elements 74 and 76, the sleeve 64 is presented at an angle as illustrated in FIG. 12. This angle is provided by the support surface defined by the block 72. The block 72 supports and is in contact with a narrow side of the sleeve 64. The sleeve pusher 60 has a relieved section on its front face just below the sleeve 64 as positioned in FIG. 12. The relief may only be a fraction of an inch. This relieved section 83 allows the lower portion of the sleeve 64 to freely expand downwardly as it goes through the opposed channel elements 74 and 76. As can be seen successively in FIGS. 14 and 16, the die expands the sleeve into its rectangular form. Correspondingly viewing FIGS. 11, 13 and 15, it can be seen that the sleeve 64 approaches and then slides over the waiting cassette 18. It has been found preferable that the opposed channel elements 74 and 76 are spaced slightly less than a full width of the rectangular sleeve. This places a slight bow on the upper and lower wide sides such that the sleeve will not hang up on the cassette. The slight angles to the flanges 80 and 82 allows this slight bowing to occur. A plate may be positioned over the opposed channels 74 and 76 to insure that the sleeve does not improperly exit the track.

Turning to FIG. 17, a schematic is illustrated of the control system. The schematic is principally directed to a pneumatic system. However, electronics additionally are employed to control the mechanism. Fiber optic sensors 84 and 86 monitor the sleeve hopper 24 and guideway 14, respectively. The machine is designed to shut down when these locations are free from the respective supply. Also illustrated on the schematic is the actuated pin 54 and the actuated pin 58 associated with the retractable stop 56. The pawl 46 and its controlling element 48 are shown to be timed with the cassette pusher 42. A sleeve pusher cylinder 88 actuates the sleeve pusher 60. The knife blades 68 and 70 are controlled through a valve 90. The remaining valves are actuated to control the various cylinders and actuators according to timing as described above.

Accordingly, a mechanism for packaging cassettes into sleeves automatically is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A mechanism for packaging tape cassettes in sleeves, each sleeve having two opposed wide sides and two opposed narrow sides to closely fit the cassettes, comprising a frame;

a guideway mounted to said frame and sized to receive cassettes therein, said guideway including a packaging station;

a loading track on said frame extending to said packaging station, said loading track having guidewalls extending along said loading track and standing upwardly from said loading track on either side thereof and flanges extending toward one another from said guidewalls, said flanges and said guidewalls forming opposed channels having first ends distant from said packaging station and second ends proximate to said packaging station, said guidewalls mutually converging toward said packaging station and being spaced one from the other at said first ends to be as wide as two adjacent sides of the sleeves lying in a plane and at said second ends to be slightly narrower than a wide side of the sleeves;

a sleeve pusher mounted to said frame to reciprocate along said track and between said guidewalls.

2. The mechanism of claim 1 wherein said guideway includes parallel guide rails spaced to receive a cassette therebetween, one said guide rail being discontinuous at said packaging station to permit lateral introduction of sleeves into said guideway.

3. The mechanism of claim 2 wherein said guideway further includes a supporting surface between said guide rails and a bump in said supporting surface adjacent said discontinuous portion of said guide rail to slightly elevate a cassette positioned in said packaging station above said supporting surface.

4. The mechanism of claim 1 wherein said guideway includes a cassette hopper sized to receive a stack of cassettes.

5. The mechanism of claim 4 further comprising a cassette pusher mounted in said guideway to reciprocate along said guideway beneath said cassette hopper.

6. The mechanism of claim 1 wherein said loading track includes a sleeve hopper sized to receive sleeves in a condition with two adjacent sides of each sleeve extending substantially in the same plane.

7. The mechanism of claim 6 wherein said sleeve hopper includes two knife blades extending inwardly from either side of said sleeve hopper and being articulated to move toward and away from the center of said sleeve hopper in unison.

8. The mechanism of claim 7 wherein said sleeve hopper is positioned above said loading track outwardly of said first ends of said channels, said sleeve pusher reciprocating along said loading track to a position outwardly of said sleeve hopper.

9. The mechanism of claim 8 wherein said knife blades are positioned above said sleeve pusher by the thickness of a sleeve when two adjacent sides of the sleeve extend in the same plane, said knife blades being retracted from said sleeve hopper with said sleeve pusher located below said sleeve hopper.

10. The mechanism of claim 6 wherein said loading track includes support surfaces beneath said sleeve hopper and extending to said opposed channels, said support surfaces and said channels being constructed and arranged to present the sleeves to said opposed channels asymmetrically such that one side edge of each sleeve is higher in said opposed channels than the opposed side edge.

11. The mechanism of claim 1 wherein said guideway includes a retractable stop, said stop engaging each cassette upon location of the cassette in said packaging station and releasing said cassette prior to advancement of said sleeve pusher to said packaging station.

12. The mechanism of claim 1 wherein said sleeve pusher includes a substantially flat forward face and a finger on the upper surface thereof extending forwardly toward said packaging station.

13. The mechanism of claim 1 wherein said guideway includes a supporting surface extending therealong, said supporting surface being lower to one side of said packaging station by an amount less than the width of a narrow side of the sleeves.

14. The mechanism of claim 1 wherein said flanges have surfaces defining said opposed channels which are inclined upwardly away from said guidewalls.

15. A mechanism for packaging tape cassettes in sleeves, each sleeve having two opposed wide sides and two opposed narrow sides to closely fit the cassettes, comprising a frame;

a guideway mounted to said frame and sized to receive cassettes therein, said guideway including a packaging station;

a loading track on said frame extending to said packaging station, said loading track having opposed channels having first ends distant from said packaging station and second ends proximate to said packaging station, said channels mutually converging toward said packaging station, and a sleeve hopper sized to receive sleeves in a condition with two adjacent sides of each sleeve extending substantially in the same plane, said sleeve hopper including gate means for releasing sleeves from said sleeve hopper to said loading track, said sleeve hopper being positioned above said loading track outwardly of said first ends of said channels;

a sleeve pusher mounted to said frame to reciprocate along said track and between said guidewalls, said sleeve pusher reciprocating along said loading track between a position outwardly of said sleeve hopper and a position adjacent said packaging station.

16. The mechanism of claim 15 wherein said gate means includes two knife blades extending inwardly from either side of said sleeve hopper and being articulated to move toward and away from the center of said sleeve hopper in unison, said knife blades being positioned above said sleeve pusher by the thickness of a sleeve when two adjacent sides of the sleeve extend in the same plane, said knife blades being retracted from said sleeve hopper with said sleeve pusher located below said sleeve hopper.

17. The mechanism of claim 14 wherein said loading track includes support runners beneath said sleeve hopper and extending to said opposed channels, said support runners and said channels being constructed and arranged to present the sleeves to said opposed channels asymmetrically such that one side each of each sleeve is higher in said opposed channels than the opposed side edge.

18. The mechanism of claim 14 wherein said sleeve pusher includes a substantially flat forward face and a finger on the upper surface thereof extending forwardly toward said packaging station.

19. The mechanism of claim 14 wherein said opposed channels include guidewalls extending along said loading track and standing upwardly from said loading track on either side thereof and flanges extending toward one another from said guidewalls, said flanges having surfaces defining said opposed channels which are inclined upwardly away from said guidewalls.

* * * * *

UNITED STATES PATENT AND TRADEMARK OFFICE

CERTIFICATE OF CORRECTION

PATENT NO. : 4,926,616

DATED : May 22, 1990

INVENTOR(S) : Zielke et al.

It is certified that error appears in the above-identified patent and that said Letters Patent is hereby corrected as shown below:

In claim 15 (column 8, line 23) delete "guidewalls" and insert therefor -- channels --.

Signed and Sealed this

First Day of October, 1991

*Attest:*

*Attesting Officer*

HARRY F. MANBECK, JR.

*Commissioner of Patents and Trademarks*